US007228909B2

(12) United States Patent
Schmidt et al.

(10) Patent No.: US 7,228,909 B2
(45) Date of Patent: Jun. 12, 2007

(54) ONE-WAY VALVE FOR A SIDE POCKET MANDREL OF A GAS LIFT SYSTEM

(75) Inventors: Ronald W. Schmidt, Richmond, TX (US); Zlatko Salihbegovic, New Iberia, LA (US); Dave Ricketts, New Orleans, LA (US); Jerry Robinson, New Orleans, LA (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 11/023,990

(22) Filed: Dec. 28, 2004

(65) Prior Publication Data

US 2006/0137881 A1 Jun. 29, 2006

(51) Int. Cl.
*E21B 43/00* (2006.01)
*E21B 33/13* (2006.01)

(52) U.S. Cl. ..... 166/372; 166/117.5

(58) Field of Classification Search ..... 166/372, 166/117.5

See application file for complete search history.

(56) References Cited

U.S. PATENT DOCUMENTS

| | | | | |
|---|---|---|---|---|
| 3,827,490 | A | 8/1974 | Moore, Jr. et al. | |
| 3,965,979 | A | 6/1976 | Lamb | |
| 4,035,103 | A * | 7/1977 | McMurry et al. | 417/109 |
| 4,066,128 | A * | 1/1978 | Davis et al. | 166/373 |
| 4,110,057 | A * | 8/1978 | McMurry et al. | 417/109 |
| 4,189,003 | A * | 2/1980 | James et al. | 166/386 |
| 4,333,527 | A | 6/1982 | Higgins et al. | |
| RE32,441 | E * | 6/1987 | Higgins et al. | 166/117.5 |
| H000635 | H * | 6/1989 | Johnson et al. | 166/310 |
| 4,976,314 | A | 12/1990 | Crawford et al. | |
| 5,058,670 | A | 10/1991 | Crawford et al. | |
| 5,066,198 | A * | 11/1991 | Decker | 417/54 |
| 5,181,566 | A * | 1/1993 | Barneck | 166/117.5 |
| 5,535,767 | A * | 7/1996 | Schnatzmeyer et al. | 137/1 |
| 5,706,891 | A | 1/1998 | Schraub | |
| 5,782,261 | A * | 7/1998 | Becker et al. | 137/155 |
| 6,227,302 | B1 * | 5/2001 | Pringle et al. | 166/374 |
| 6,247,536 | B1 * | 6/2001 | Leismer et al. | 166/305.1 |
| 6,491,105 | B2 | 12/2002 | Holt, Jr. | |
| 6,715,550 | B2 * | 4/2004 | Vinegar et al. | 166/250.15 |
| 6,758,277 | B2 * | 7/2004 | Vinegar et al. | 166/372 |

OTHER PUBLICATIONS

EP Search Report, Application No. 05112053.3, dated Apr. 28, 2006.

* cited by examiner

*Primary Examiner*—David Bagnell
*Assistant Examiner*—Nicole A Coy
(74) *Attorney, Agent, or Firm*—Patterson & Sheridan, L.L.P.

(57) ABSTRACT

Embodiments include providing a gas lift system comprising production tubing disposed within a wellbore, the production tubing capable of allowing fluid flow in a first direction from outside the production tubing through a wall of the production tubing to inside the production tubing to introduce a gas into the bore of the production tubing, while preventing fluid flow in a second direction from inside the production tubing through the wall of the production tubing to outside the production tubing. In one aspect, fluid flow in the second direction is prevented by operation of at least two valve members disposed within a side pocket of a side pocket mandrel in the production tubing. At least one of the valve members is capable of preventing fluid flow in the second direction even when the other valve member is removed from the wellbore or is at least partially inoperative.

29 Claims, 7 Drawing Sheets

ONE-WAY VALVE FOR A SIDE POCKET MANDREL OF A GAS LIFT SYSTEM

BACKGROUND OF THE INVENTION

1. Field of the Invention

Embodiments of the present invention generally relate to artificially lifting fluid from a wellbore. More particularly, embodiments of the present invention relate to artificially lifting fluid from a wellbore using a gas lift system.

2. Description of the Related Art

To obtain hydrocarbon fluids from an earth formation, a wellbore is drilled into the earth to intersect an area of interest within a formation. The wellbore may then be "completed" by inserting casing within the wellbore and setting the casing therein using cement. In the alternative, the wellbore may remain uncased (an "open hole wellbore"), or may become only partially cased. Regardless of the form of the wellbore, production tubing is typically run into the wellbore primarily to convey production fluid (e.g., hydrocarbon fluid, which may also include water) from the area of interest within the wellbore to the surface of the wellbore.

Often, pressure within the wellbore is insufficient to cause the production fluid to naturally rise through the production tubing to the surface of the wellbore. Thus, to carry the production fluid from the area of interest within the wellbore to the surface of the wellbore, artificial lift means is sometimes necessary.

Some artificially-lifted wells are equipped with sucker rod lifting systems. Sucker rod lifting systems generally include a surface drive mechanism, a sucker rod string, and a downhole positive displacement pump. Fluid is brought to the surface of the wellbore by pumping action of the downhole pump, as dictated by the drive mechanism attached to the rod string.

One type of sucker rod lifting system is a rotary positive displacement pump, typically termed a progressive cavity pump ("PCP"). The progressive cavity pump lifts production fluid by a rotor disposed within a stator. The rotor rotates relative to the stator by use of a sucker rod string.

An additional type of sucker rod lifting system is a rod lift system, with which fluid is brought to the surface of the wellbore by reciprocating pumping action of the drive mechanism attached to the rod string. Reciprocating pumping action moves a traveling valve on the positive displacement pump, loading it on the down-stroke of the rod string and lifting fluid to the surface on the up-stroke of the rod string.

Sucker rod lifting systems include several moving mechanical components. Specifically, the rod strings of sucker rod lifting systems must be reciprocated or rotated to operate the lifting systems. In some applications, the moving parts are disadvantageous. When a subsurface safety valve is employed within the wellbore, such as within an offshore well, a sucker rod string cannot be placed through the subsurface safety valve. Additionally, moving parts are susceptible to failure or damage, potentially causing the sucker rod lifting systems to become inoperable.

An alternative lift system is a gas lift system. Gas lift systems are often the preferred artificial lifting systems because fewer moving parts exist during the operation of the gas lift systems than during the operation of sucker rod lift systems. Moreover, gas lift systems are sometimes preferred over sucker rod lift systems because no sucker rod is required in the operation of gas lift systems. Because a sucker rod is not used in operating the gas lift system, the gas lift system is usable in offshore wells having subsurface safety valves.

Two primary types of gas lift systems exist: tubing-retrievable gas lift systems and wireline-retrievable gas lift systems. Each type of gas lift system includes several gas lift valves, which are typically internal one-way valves spaced along the inner diameter of the production tubular. The gas lift valves allow fluid flow from an annulus between the casing and the production tubing to lift production fluid flowing through the production tubing, yet the gas lift valves prevent fluid flow from the longitudinal bore running through the production tubing into the annulus.

During the course of a gas lift operation, access to the gas lift valves by the operator is often necessary for several reasons. First, the gas lift valves typically require maintenance, repair, or replacement, for example if the valve is leaking fluid flow into the annulus from the production tubing bore. In fact, normal operations require repair or replacement of the gas lift valves every six months to one year of operation of the gas lift system. Second, altering the pressure settings of the gas lift valves, which is often required during a gas lift operation, requires access to the gas lift valves by the operator.

When tubing-retrievable gas lift systems are utilized, the entire production tubing string must be retrieved from the wellbore to allow access to the gas lift valves for repair, maintenance, replacement, or changing of the pressure settings of the gas lift valves, because the production tubing and gas lift valves are integral to one another. In contrast, wireline-retrievable gas lift systems permit retrieving of the gas lift valves from the wellbore using wireline without necessitating the removal of the production tubing from the wellbore. Removing the entire production tubing from the wellbore is costly and inefficient; therefore, wireline-retrievable gas lift systems are often the preferred type of gas lift system, especially when the gas lift system is used offshore or in remote locations where rig interventions are expensive.

A typical wireline-retrievable gas lift system 10 is shown in FIG. 1. Generally, compressed gas G is injected into an annulus 15 between an outer diameter of a production tubing string 20 and the inner diameter of casing 25 within the wellbore 30. A valve system 35 supplies injection gas G and allows produced fluid to exit the gas lift system 10.

Spaced within the production tubing string 20 are side pocket mandrels 40 having gas lift valves 45 within side pockets 90 thereof, the side pockets 90 of the side pocket mandrels 40 being offset from the centerline of the production tubing string 20. The gas lift valves 45 are one-way valves used to allow gas flow from the annulus 15 into the production tubing string 20 and to disallow gas flow from the production tubing string 20 into the annulus 15.

A production packer 50 located at a lower end of the production tubing string 20 forces the flow of production fluid P from a reservoir or zone of interest in a formation 55 up through the production tubing string 20 instead of up through the annulus 15. Additionally, the production packer 50 forces the gas flow from the annulus 15 into the production tubing string 20 through the gas lift valves 45, as gas G is not allowed to flow further down into the annulus 15 past the production packer 50.

In operation, production fluid P flows from the formation 55 into the wellbore 30 through perforations 60 through the casing 25 and the formation 55. The production fluid P flows into the production tubing string 20. When it is desired to lift the production fluid P with gas G, compressed gas G is introduced into the annulus 15. The gas lift valves 45 allow the gas G to flow into the production tubing string 20 while preventing the flow of the production fluid P into the annulus 15 through the gas lift valves 45.

FIG. 1A shows a section of a typical wireline-retrievable production tubing string 20 having a side pocket mandrel 40 therein. The gas lift valve within the side pocket 90 of the side pocket mandrel 40 is not shown in FIG. 1A. A first slot 67 through a wall of the side pocket mandrel 40 exists below the gas lift valve on one side of the wall of the side pocket 90 of the side pocket mandrel 40, and a second slot 69 through a wall of the production tubing 20 exists above the gas lift valve on the opposite side of the wall of the side pocket 90.

Referring to both FIGS. 1 and 1A, compressed gas G introduced into the annulus 15 flows through each first slot 67 into each side pocket 90, through each gas lift valve 45, and then out each side pocket 90 through each second slot 69 into the bore of the production tubing string 20. The gas flow into the bore of the production tubing string 20 helps lift the production fluid P to the surface of the wellbore 30 by lowering the density of the production fluid P. Also, the injected gas G lowers the hydrostatic pressure in the production tubing 20 to re-establish the required pressure differential between the reservoir and the wellbore 30, thereby causing the production fluid P to flow to the surface of the wellbore 30. At the same time, the gas lift valves 45 prevent fluid flow through the side pockets 90 in the direction from the production tubing string 20 bore into the annulus 15.

At various times during the gas lift operation, the gas lift valve must be removed for repair, maintenance, and/or changing of pressure settings of the gas lift valve. Moreover, the gas lift valve may fail or leak during the gas lift operation. Removal of the gas lift valve from the production tubing and/or failing or leaking of the gas lift valve are problematic because the gas lift valve is no longer present within the side pocket mandrel or is no longer effective to prevent fluid flow from the production tubing into the annulus. Therefore, production fluid flowing up from the reservoir through the production tubing string is allowed to flow into the annulus unhindered through the side pockets of the side pocket mandrels.

The presence of production fluid in the annulus is problematic for several reasons. First, the production fluid is corrosive to the casing surrounding the production tubing string and may therefore cause corrosion damage to the casing. Second, the production fluid existing within the annulus increases the fluid pressure present within the annulus, possibly increasing to sufficient pressure levels to cause damage to the casing surrounding the production tubing string. Damaging the casing could cause the production fluid to leak back into the formation through holes in the casing, resulting in loss of valuable production fluid as well as becoming an environmental hazard. Repairing this damage to the casing is very expensive, especially in the form of loss of production during the repair time, as the production tubing string and other gas lift equipment must be removed from the wellbore and a casing section or casing patch must be re-installed within the wellbore over the damaged portion of the casing.

Additionally, the presence of production fluid in annulus is problematic because, even without resulting damage to the casing, time-consuming preparatory activities must be carried out before the gas lift operation may resume after re-installing the gas lift valves within the side pockets of the side pocket mandrels. One especially time-consuming operation which must be accomplished prior to resuming the gas lift operation involves unloading the production fluid present within the annulus from the wellbore. Unloading the well, if production fluid is present within the production tubing as well as within the annulus, often takes twelve hours or more every time the gas lift valves must be removed from the production tubing. Unloading the production fluid from the annulus typically consumes 8–9 hours of that unloading time. This time required to unload the annulus prior to any further gas lift operation wastes valuable production time, decreasing the profitability of the well.

Therefore, it would be advantageous to provide a gas lift system which reduces damage to the surrounding casing when the gas lift valve is ineffective and/or is removed from the production tubing. It would be further advantageous to provide a gas lift system which decreases the time necessary to unload the well prior to resuming a gas lift operation when the gas lift valve is ineffective and/or is removed from the production tubing. Furthermore, it would be beneficial to provide a gas lift system and operation capable of preventing flow of production fluid into the annulus when the gas lift valve is ineffective and/or is removed from the production tubing.

SUMMARY OF THE INVENTION

In one aspect, embodiments of the present invention generally include a gas lift system for use in a wellbore, comprising at least one side pocket mandrel having a side pocket therein; a first, retrievable one-way valve member within the side pocket for preventing fluid flow from within the mandrel to outside the mandrel; and a second one-way valve member within the side pocket, the first and second one-way valve members in fluid communication with one another.

In another aspect, embodiments of the present invention generally provide a method of preventing fluid flow from a bore of production tubing to an annulus between an outer diameter of the production tubing and a wellbore, comprising providing the production tubing having a side pocket mandrel therein in the wellbore, the side pocket mandrel having a side pocket with at least one first valve member therein and at least one second valve member; introducing a gaseous fluid into the annulus; flowing the gaseous fluid from the annulus into the bore through the side pocket mandrel; and preventing flow of a second fluid from the bore into the annulus using at least one of the valve members. In yet another aspect, embodiments of the present invention include a method of preventing fluid from flowing from a bore of production tubing disposed within a wellbore into an annulus between an outer diameter of the production tubing and the wellbore, comprising providing the production tubing within the wellbore, the production tubing comprising a side pocket mandrel having a side pocket therein, and at least two one-way valves disposed within the side pocket; using at least one of the one-way valves to prevent fluid flow in a first direction from the bore to the annulus; and allowing flow of a gaseous fluid in a second direction from the annulus into the bore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention include a gas lift system having one or more one-way valves present within one or more side pocket mandrels in a production tubing string, the one or more one-way valves in addition to the gas lift valves present within the side pocket mandrels. The one or more one-way valves beneficially provide the security of an additional barrier to production fluid flow from the production tubing into the wellbore annulus through the side pockets during operation of one or more gas lift valves within the one or more side pockets. Therefore, the one or more one-way valves back up the one or more gas lift valves in case the gas lift valves fail and/or leak production fluid for any reason, e.g., because of failure of the sealing mechanisms of the gas lift valves.

The one or more one-way valves of the gas lift system of embodiments of the present invention further advantageously allow removal of the gas lift valves for repair, maintenance, and/or replacement of the one or more gas lift valves during a gas lift operation without eliminating the only barrier to production fluid flow into the annulus. The one-way valves thus provide the default barrier to production fluid flow from the production tubing into the annulus.

Including the one or more one-way valves in the gas lift system of embodiments of the present invention provides the advantage that production fluid is prevented from flowing from the production tubing into the annulus when one or more of the gas lift valves become ineffective for keeping fluid from the annulus or when one or more of the gas lift valves are removed from the wellbore for repair, maintenance, replacement, changing pressure settings of the valves, or for any other reason. Preventing production fluid from flowing into the annulus beneficially reduces corrosion of the casing lining the wellbore by production fluid, decreases damage to the casing by over-pressurizing the annulus with fluid pressure from the production fluid, and drastically reduces time and cost necessary for unloading the wellbore prior to resuming the gas lift operation by eliminating the need to unload the annulus.

Figure 2:
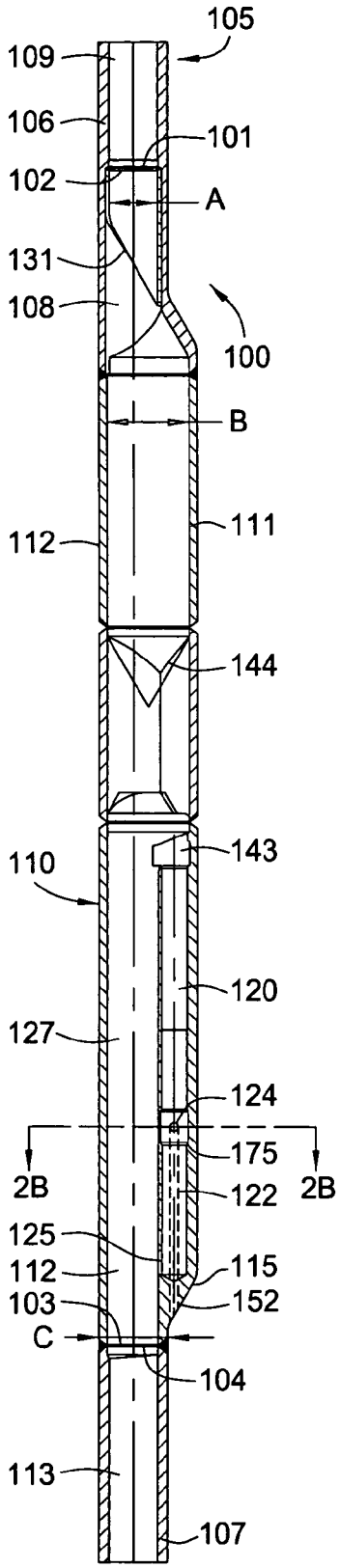
FIG. 2 is a section view of a gas lift mandrel of a gas lift system of the present invention.

FIG. 2 shows a section of a gas lift system 100 of an embodiment of the present invention. The gas lift system 100 includes a production tubing string 105 including a first tubular 106, a side pocket mandrel 110, and a second tubular 107. A lower end 101 of the first tubular 106 is operatively connected, preferably threadedly connected, to an upper end 102 of the side pocket mandrel 110, and a lower end 103 of the side pocket mandrel 110 is operatively connected, preferably threadedly connected, to an upper end 104 of the second tubular 107. The first tubular 106 and/or second tubular 107 may be conventional tubular sections typically utilized within a production tubing string, or in the alternative, the first and/or second tubulars 106, 107 may be additional side pocket mandrels substantially similar to the side pocket mandrel 110.

The upper end 102 of the side pocket mandrel 110 preferably has a bore 108 which is generally the same size as a bore 109 of the lower end 101 of the first tubular 106. At a predetermined distance from the upper end 102, the inner diameter A of the side pocket mandrel 110 increases gradually at an angle to a larger inner diameter B. Only one side 111 of the side pocket mandrel 110 diverges outward, while the other side 112 stays the same. Similarly, the lower end 103 of the side pocket mandrel 110 has generally the same size bore 112 as the bore 113 of the upper end 104 of the second tubular 107. The bore 112 has an inner diameter E and increases to a larger inner diameter D on the side 111. Preferably, the inner diameter D is substantially the same as the inner diameter B.

Figure 2A:
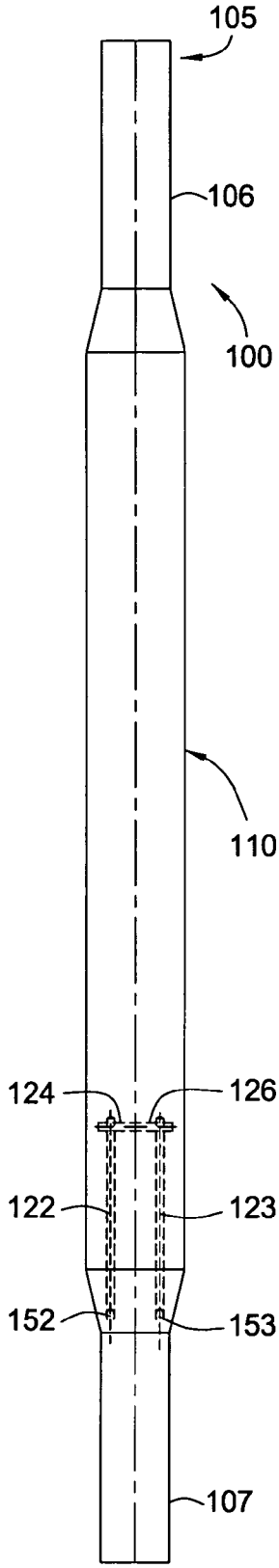
FIG. 2A is a downward view of the gas lift mandrel of FIG. 2.
Figure 2B:
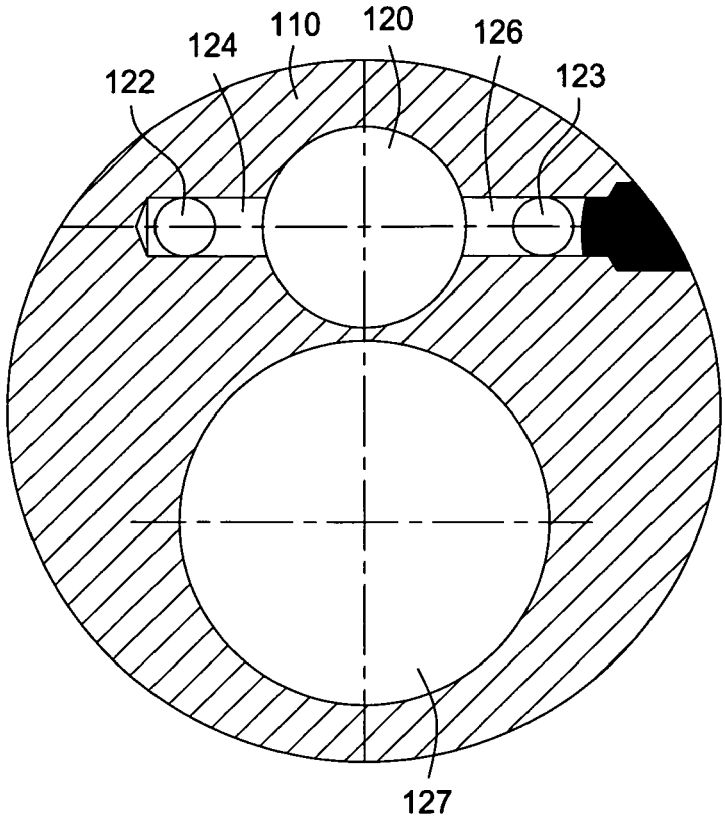
FIG. 2B is a cross-sectional view of the gas lift mandrel of FIG. 2 along line 2B—2B.

FIG. 2B depicts the side pocket mandrel 110 along line 2B—2B of FIG. 2. Included within the side pocket mandrel 110 are a generally longitudinal production tubing bore 127 and another longitudinal bore in the form of a side pocket 120. Preferably, but not necessarily, the side pocket 120 is smaller in inner diameter than the production tubing bore 127. Also preferably, but not necessarily, the production tubing bore 127 is of substantially the same inner diameter from the bores 112 and 108 to the cross-section 2B—2B.

As shown in FIG. 2, a slot 125 from the side pocket 120 to the bore 127 exists through the wall of the side pocket mandrel 110 between the side pocket 120 and the bore 127. The slot 125 provides a fluid communication path between the side pocket 120 and the bore 127 of the side pocket mandrel 110. As will be described in greater detail, the slot is particularly useful when remotely reinstalling a gas lift valve.

Referring now to FIGS. 2, 2A, and 2B, extending through an end wall 115 of the side pocket mandrel 110 are a first port 122 and a second port 123, the ports 122, 123 spaced across from one another on opposite sides of the side pocket mandrel 110. The end wall 115 is substantially solid wall, as the side pocket 120 is not formed therethrough at this point of the wall. When the portion of the side pocket mandrel 110 having the side pocket 120 therein is reached by the ports 122, 123, the ports 122, 123 further extend through walls of the side pocket mandrel 110 surrounding the side pocket 120, as shown in a top view of the side pocket mandrel 110 depicted in FIG. 2A. The ports 122, 123 are axially spaced from one another on each side of the side pocket 120, as also shown in FIG. 2B.

The ports 122, 123 then feed into a third port 124 and fourth port 126, respectively, through opposing walls. The third and fourth ports 124, 126 extend towards one another and towards the bore of the side pocket 120, as shown in FIGS. 2A and 2B specifically, with respect to the first and second ports 122, 123. Eventually, the third and fourth ports 124, 126 both feed into a common side pocket 120 so that fluids flowing through the third and fourth ports 124, 126 may mingle with one another.

Figure 3:
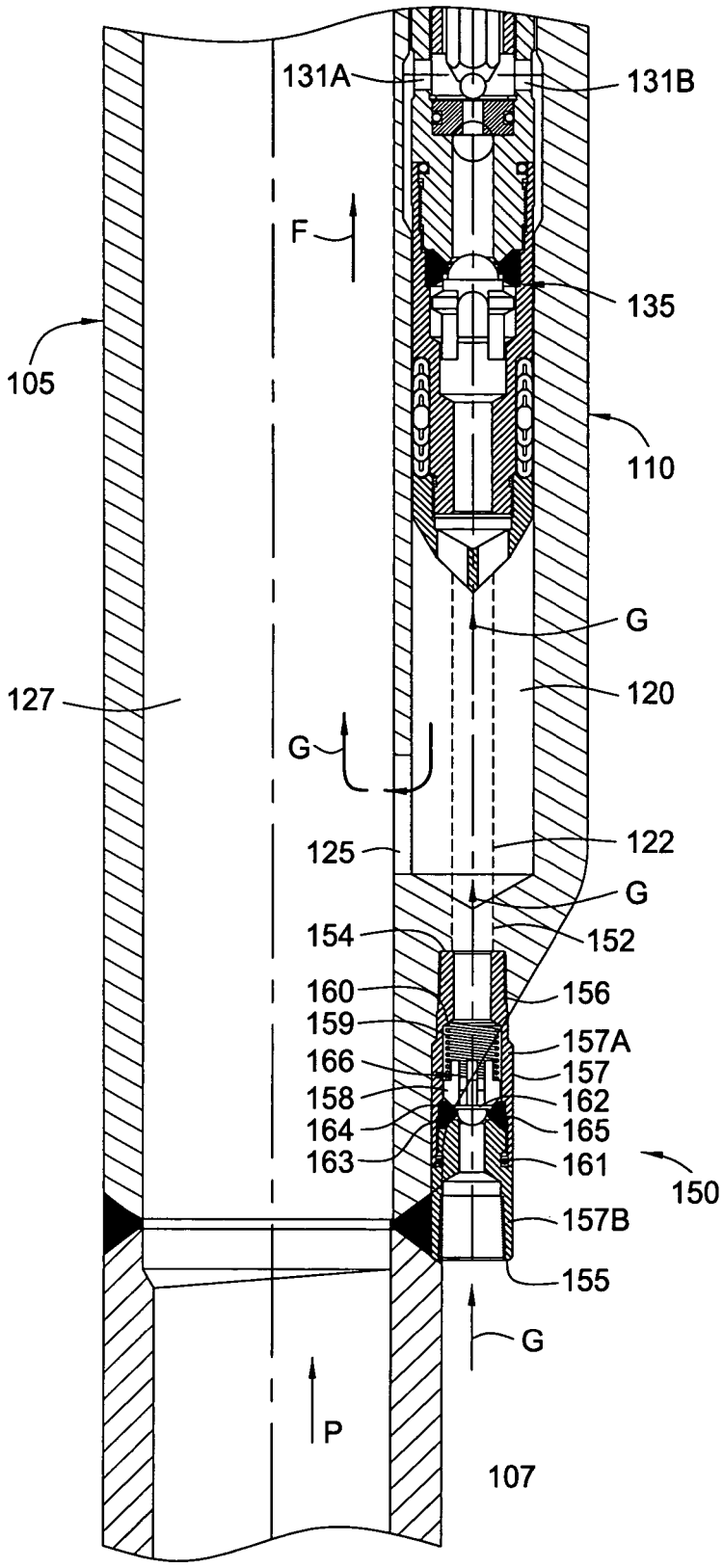
FIG. 3 is a section view of a portion of the side pocket mandrel of the gas lift system of the present invention, showing a gas lift valve and a one-way valve.
Figure 5:
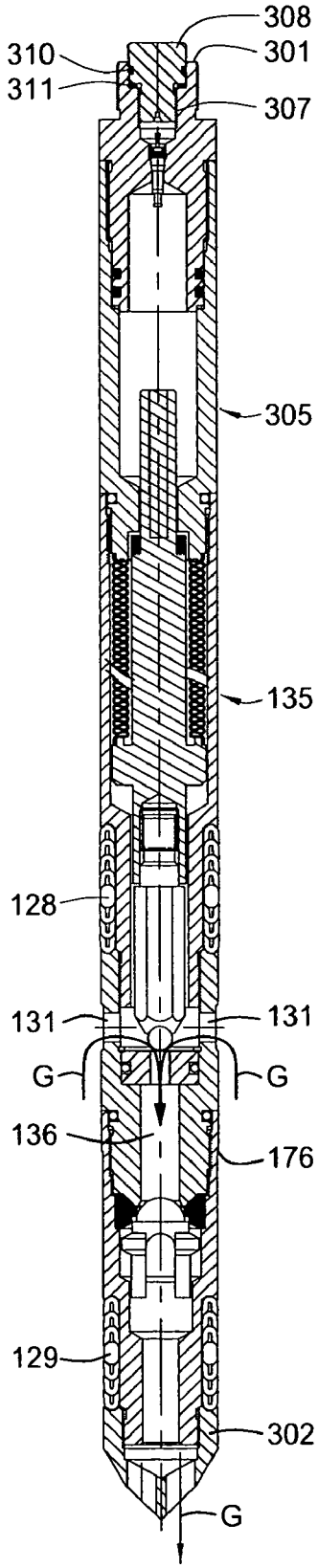
FIG. 5 is a sectional view of a gas lift valve usable with the gas lift system of the present invention.

Now referring to FIGS. 3 and 5, a gas lift valve 135 is disposed within the side pocket 120 of the side pocket mandrel 110. The gas lift valve 135 is generally a one-way valve, preferably a check valve, which allows fluid flow therethrough in only one direction. Generally, the gas lift valve 135 permits fluid flow through the side pocket 120 in a first direction from an annulus between the outer diameter of the production tubing string 105 and the surrounding wellbore into the bore 127 of the production tubing string 105, while preventing fluid flow through the side pocket 120 in the opposite, second direction from the bore of the production tubing string 105 to the annulus.

The gas lift valve 135 includes a central bore 136 longitudinally disposed therethrough and at least two concentrically spaced slots 131A, 131B therearound (as shown in FIG. 5 fluidly connecting the central bore 136 to the outside of the gas lift valve 135. The location of the slots 131A, 131B on the gas lift valve 135 is predetermined to permit fluid communication of the slots 131A, 131B with the third and fourth ports 124, 126, respectively, when the gas lift valve 135 is properly positioned within the side pocket 120. In other words, when the gas lift valve is properly positioned within the side pocket 120, the third port 124 is aligned with the slot 131A and the fourth port 126 is aligned with the slot 131B.

Referring now to FIG. 2B, the gas lift valve 135 is located within the side pocket 120. The outer diameter of the gas lift valve 135 is generally commensurate with the diameter of the side pocket 120 to provide a snug fit for the gas lift valve 135 within the side pocket 120 and allow for a sealed interface between the gas lift valve 135 and the side pocket mandrel 110, thereby providing a sealed fluid path through the slots 131A, 131B and the ports 124, 126.

The sealed fluid path is produced using a first sealing assembly 129 and a second sealing assembly 128, as shown in FIG. 5. The first and second sealing assembly 129, 128 are located above and below the slots 131A, 131B to straddle the slots 131A, 131B and to seal around the slots 131A, 131B and ports 124, 126 when the sealing assemblies 129, 128 are activated to contact the surrounding side pocket mandrel 110 wall. The sealing assembly 129 is illustrated contacting the surrounding wall of the side pocket 120 of the side pocket mandrel 110 in FIG. 3.

FIG. 5 shows the gas lift valve 135 in detail. The gas lift valve 135 includes a tubular body 305 having a generally longitudinal central bore 136 therethrough and having an upper end 301 and a lower end 302. The lower end 302 is the end closest to the one-way valve 150, (other not shown) when the gas lift valve 135 is positioned within the side pocket 120 (shown in FIG. 3). The upper end 301 includes connecting means for connecting the gas lift valve 135 to a latching mechanism 145 (see FIG. 6). The connecting means depicted in FIG. 5 includes male threads disposed on the upper end 301 of the gas lift valve 135.

The upper end of the bore 136 includes a plug profile 307. Within the plug profile 307 fits a plugging member 308 for preventing debris from entering the bore 303 from the upper end. The plugging member 308 is preferably threadedly connected to the gas lift valve 135 by threads corresponding to female threads on the plug profile 307. At the interface between the plugging member 308 and the plug profile 307 are optionally one or more sealing members 310, which are most preferably one or more o-ring seals, and/or one or more gasket rings 311 for sealing the interface between the plug profile 307 and the plugging member 308.

The remainder of the gas lift valve 135, including its structure and operation, is shown and described in commonly owned U.S. Pat. No. 6,491,105 issued Dec. 10, 2002, which is herein incorporated by reference in its entirety. Specifically, the gas lift valve shown and described in relation to FIGS. 3*a*1, 3*a*2, 3*b*1, 3*b*2, 4*a*, and 4*b* are usable in embodiments of the present invention as the gas lift valve 135.

The gas lift valve 135 is preferably removable from and re-installable in the side pocket 120 of the side pocket mandrel 110 while the production tubing string 105 remains downhole within the wellbore. This retrieving and re-installing of the gas lift valve 135 may be accomplished by any tool capable of performing these functions which is known to those skilled in the art. In one example, a kickover tool (not shown) is utilized to locate the gas lift valve 135 within the side pocket 120 and/or to obtain the gas lift valve 135 from the side pocket 120. Exemplary kickover tools which may be used to retrieve and/or install or re-install the gas lift valve 125 within the side pocket 120 are shown and described in U.S. Pat. No. 3,965,979 issued Jun. 29, 1976 and in U.S. Pat. No. 4,976,314 issued on Dec. 11, 1990, which are both herein incorporated by reference in their entirety.

The side pocket mandrel 110 may include an orienting sleeve 131 therein (see FIG. 2) for correctly orienting the gas lift valve 135 within the side pocket 120. The orienting sleeve 131 may be of the variety shown and described in either of the above-incorporated-by-reference patents. In any event, the orienting sleeve 131 catches the kickover tool, then orients the kickover tool so that the "kickover" of the gas lift valve 135 by the kickover tool lands the gas lift valve 135 within the side pocket 120 and with the slots 131A, 131B aligned with their intended ports 124, 126.

An undercut portion 175 (see FIG. 2) disposed at a predetermined location within the side pocket 120 of the side pocket mandrel 110 provides a stop shoulder for a shoulder 176 (see FIG. 5) of the gas lift valve 135 disposed at a predetermined location on the outer surface of the gas lift valve 135. The undercut portion 175 dictates the positioning of the gas lift valve 135 within the side pocket 120 so that the ports 124, 126 align with the slots 131A, 131B. The predetermined locations of the undercut portion 175 and the shoulder 176 are calculated to allow the kickover tool to correctly position the gas lift valve 135 within the side pocket 120 while the production tubing string 105 remains downhole within the wellbore.

Figure 6:
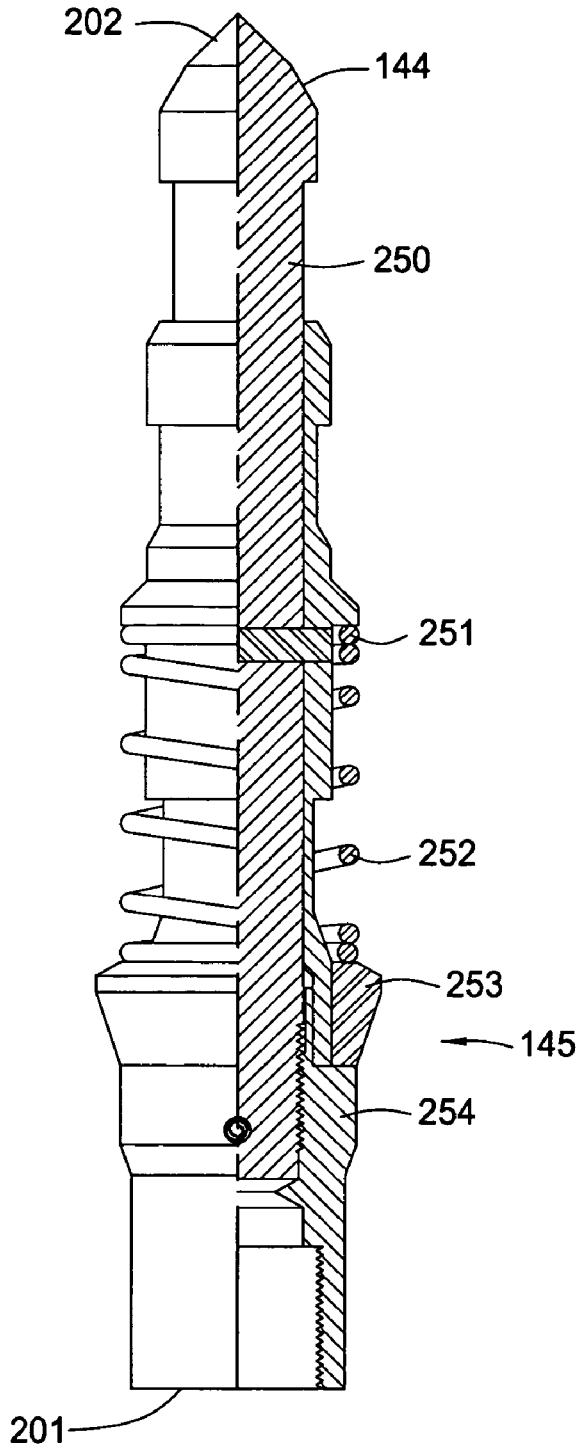
FIG. 6 is a sectional view of a latch usable with the gas lift system of the present invention.

Again referring to FIG. 2, substantially adjacent to the side pocket 120 is a latch recess area 143 for retaining a latch mechanism 145 (see FIG. 6) therein. The latch mechanism 145 is utilized to hold the gas lift valve 135 in place within the side pocket 120. An exemplary latch mechanism 145 usable with embodiments of the present invention is shown in FIG. 6, although it is contemplated that embodiments of the latch mechanism of the present invention include any mechanism capable of retaining the gas lift valve 135 within the side pocket 120.

The latch mechanism 145 also aids in retrieval of the gas lift valve 135 from the side pocket 120 and in installation of the gas lift valve 135 within the side pocket 120, as the latch mechanism 145 provides a latching profile 144 for a matching profile (not shown) in the kickover tool (not shown) to engage, thereby allowing the kickover tool to remove and/or install the latching mechanism 145 and the operatively connected gas lift valve 135 from or into the side pocket 120. The kickover tool is preferably designed to selectively locate side pocket mandrels.

The latch mechanism 145 includes a body 250 having an upper end 202 and a lower end 201. The upper end 202 includes the latching profile 144 capable of engagement by the retrieving tool, and the lower end 202 includes connecting means, preferably female threads, to permit connection of the latching mechanism 145 to the upper end of the gas lift valve 135.

A frangible member, which is preferably a shear pin 251, is disposed on an outer surface of the body 250. The shear pin 251 releasably connects the latch mechanism 145 within the latch recess area 143. Located below the shear pin 251 and surrounding an outer surface of the body 250 is a resilient member, preferably a spring 252. Disposed below the spring 252 and abutting the lower end of the spring 252 is a latch ring 253 abutted at its lower end by a latch stop 254. The latch ring 253 and latch stop 254 cooperate to provide means for connecting the latching mechanism 145 within the latch recess area 143 to anchor the gas lift valve 135 within the side pocket 120.

Referring now to FIG. 2A, a one-way valve 150, (other not shown) is located at a side pocket entrance 152, 153 of each of the first and second ports 122, 123. The one-way valves 150, (other not shown) are preferably check valves, but instead may be any other one-way valve known to those skilled in the art. The one-way valves 150, (other not shown) allow gas G flow into the one-way valves 150, (other not shown) in a first direction from the annulus into the side pocket 120, but do not allow fluid flow in a second direction through the one-way valves 150, (other not shown) from the side pocket 120 to the annulus. Although two ports 122, 123 and two one-way valves 150, (other not shown) are shown and described herein as an embodiment of the present invention, it is within the scope of embodiments of the present invention that more than two ports having more than two corresponding one-way valves or, in the alternative, only one port having only one one-way valve may be utilized.

The first one-way valve 150 in the form of a check valve is described in reference to FIG. 3. Although this description only includes the first one-way valve 150, it is understood that the second one-valve (not shown) which is hooked up to the second port 123 may be substantially the same as the first one-way valve 150 hooked up to the first port 122. The one-way valves 150, (other not shown) are external one-way valves because they prevent fluid flow from the side pocket 120 into the annulus and are primarily external to the side pocket mandrel 110 (and not located within the side pocket 120).

The first one-way valve 150 includes a generally tubular body 157 having a first end 154 and a second end 155. The body 157 may include one tubular member or may instead include two or more tubular members connected to one another, preferably threadedly connected. As shown in FIG. 3, in one embodiment the body 157 includes a first tubular member 157A threadedly connected to a second tubular member 157B. One or more sealing members 161, which are preferably o-ring seals, are optionally disposed between the first tubular member 157A and the second tubular member 157B to seal the interface between the two tubular members 157A, 157B.

The first end 154 preferably has male threads thereon for mating with corresponding female threads on a receiving portion 156 of the side pocket mandrel 110. The second end 155 preferably includes female threads. In other embodiments, the first end may instead include female threads for mating with corresponding male threads on the receiving portion 156, and the second end 155 may instead include male threads. One or more sealing members (not shown), which are preferably o-ring seals, may optionally be located at the interface between the first end 154 and the receiving portion 156 to provide a sealed connection between the first one-way valve 150 and the side pocket mandrel 110.

Extending through the first one-way valve 150 is a generally longitudinal bore 158. Within the bore 158 is a resilient biasing member, which is preferably a compression spring 159. At one end, the spring 159 abuts a shoulder 160 formed by an inner diameter restriction within the bore 158. At its other end, the spring 159 abuts a check member 162.

The check member 162 is prevented from moving towards the second end 155 by a check seat 163. Due to the bias force of the spring 159, the check member 162 remains forced against the check seat 163 and is prevented from movement absent any force in the direction towards the side pocket 120 (e.g., the force of compressed gas). When the check member 162 exists against the check seat 163 due to the bias force of the spring 159, the one-way valve 150 is closed and prevents fluid flow in either direction. To open the one-way valve 150, the bias force of the spring 159 must be overcome by pressure within the annulus to force the check member 162 through a check drop 166 in the direction of the side pocket 120.

One or more check sealing members 164, preferably o-ring seals, along with one or more check seal retainers 165 are optionally included to seal the interface between the check member 162 and the check seat 163 when the one-way valve 150 is closed, thereby preventing fluid flow around the check member 162. The check seal retainers 165 prevent unwanted extrusion of the check sealing members 164.

Figure 4:
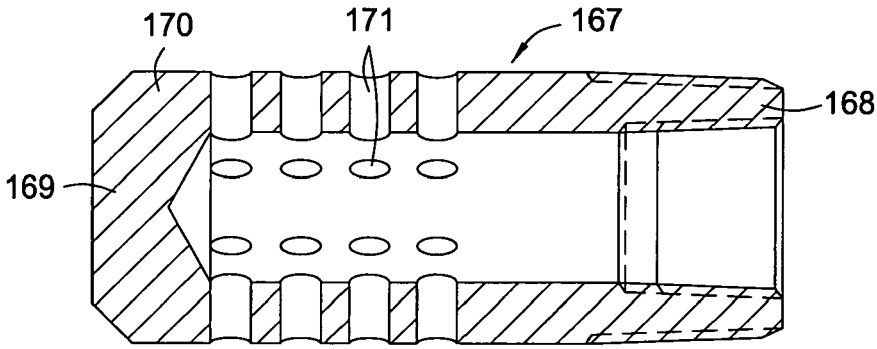
FIG. 4 is a sectional view of a screen usable with the gas lift system of the present invention.

Preferably, a screen member 167, an example of which is shown in FIG. 4, is operatively attached to the one-way valve 150 to prevent particulate matter or other solids from penetrating the one-way valve 150. If not prevented entry into the gas lift system 100, the particulate matter could negatively affect the operation of the one-way valve 150 or gas lift valve 125 and/or could contaminate the gas G or production fluid P.

The screen member may include any tool capable of filtering the solid particles from the gas G, including but not limited to a diffuser or other type of solids barrier. The screen member 167 shown in FIG. 4, which is merely an exemplary device attachable to the one-way valve 150, includes a tubular body 170 having a first end 168 and a second end 169. The second end 169 is preferably closed from fluid flow therethrough, while the first end 168 is open to fluid flow therethrough and preferably includes male threads for connecting to corresponding female threads on the second end 155 of the one-way valve 150.

The body 170 of the screen member 167 includes one or more perforations 171 therethrough. The perforations 171 prevent solid particles which are larger than the perforations 171 from flowing into a bore of the screen member 167, thereby stopping the particles from entering the bore of the one-way valve 150. A screen member which is at last substantially the same in structure and operation as the screen member 167 is preferably also connected to the second end of the second one-way valve (not shown).

Either or both of the gas lift valve 135 and the one-way valves 150, (other not shown) may be either 1-inch valves, 1.5-inch valves, or any other size valves. The gas lift mandrel 110 is preferably approximately 4.5 inches in outer diameter and preferably approximately 6–10 feet in height, but may be any size for purposes of embodiments of the present invention. The one-way valves 150, (other not shown) are preferably injection pressure operated ("IPO") valves controlled by the fluid (gas) pressure outside the side pocket mandrel 110, as is depicted and described above, but alternate embodiments may instead involve production pressure operated ("PPO") and/or differential pressure operated valves or any other one-way valves known to those skilled in the art. Preferably, the one-way valves 150, (other not shown) include positive-loaded one-way valves (positive-loaded due to the presence of the spring 159), although other types of one-way valves are contemplated for use in alternate embodiments of the present invention, including velocity check valves.

Figure 1:
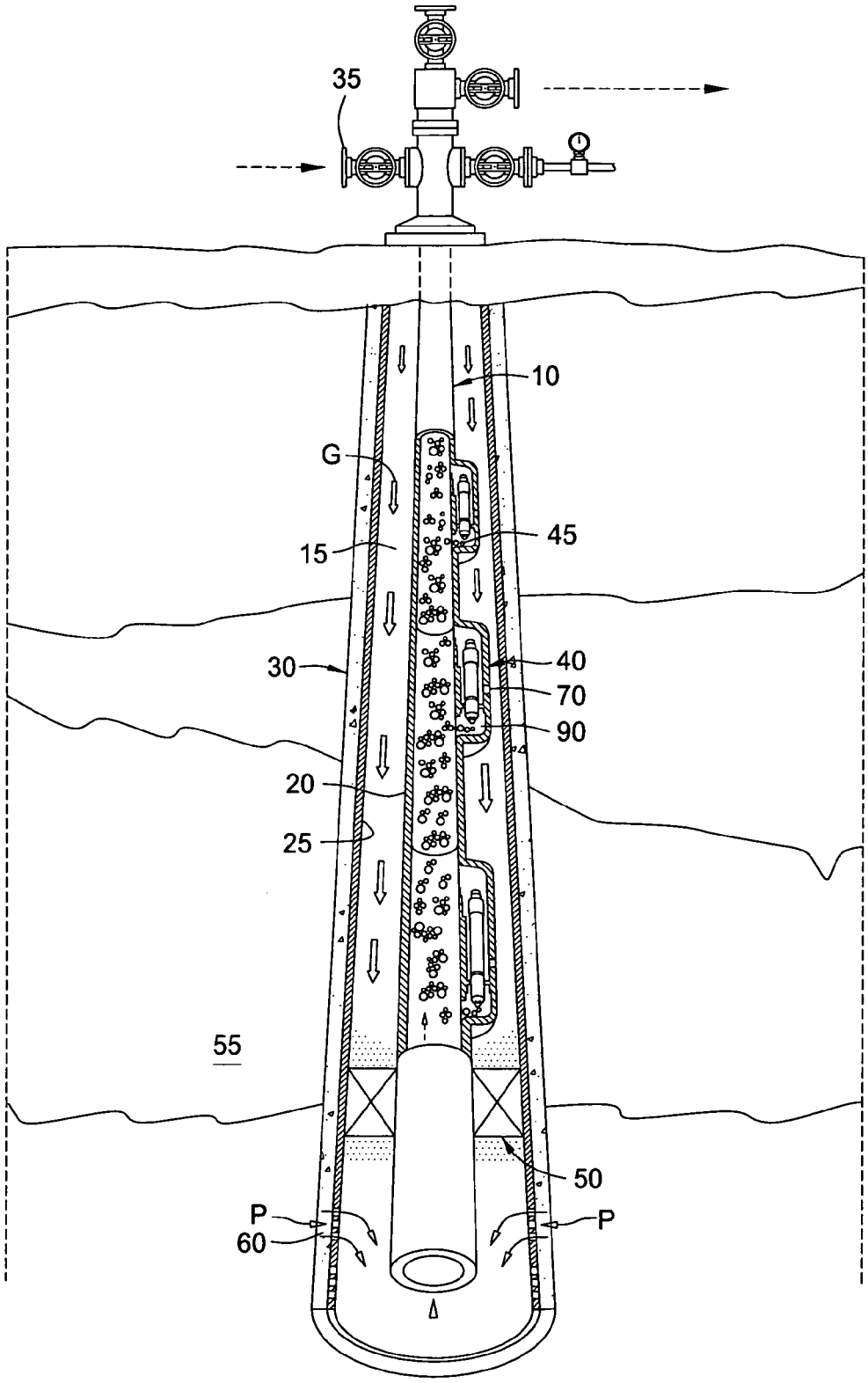
FIG. 1 shows a typical gas lift system.
Figure 1A:
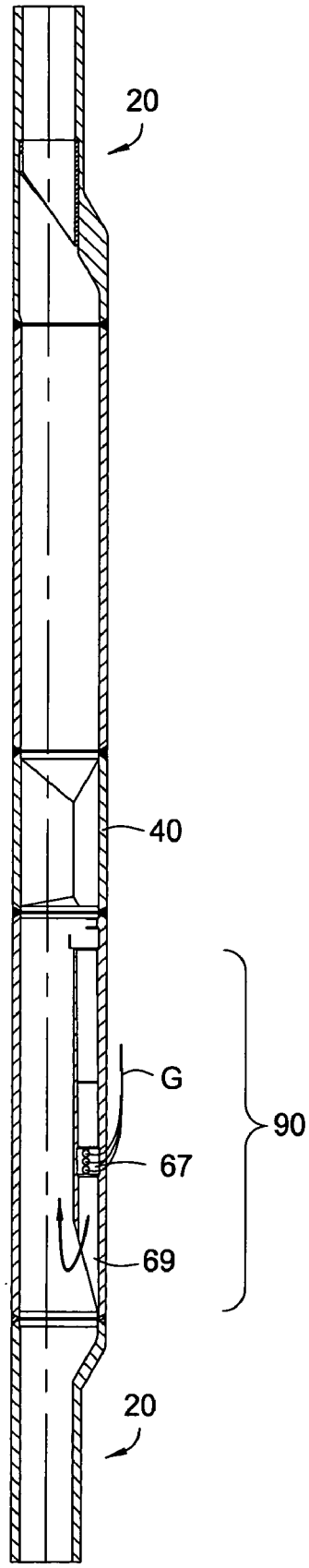
FIG. 1A shows a side pocket mandrel of the gas lift system of FIG. 1.

In operation, the production tubing string 105 is assembled to include one or more side pocket mandrels 110 therein. A gas lift valve 135 is installed in each side pocket mandrel 110, and the production tubing string 105 is then inserted into the wellbore (not shown). Referring to FIG. 1, the production packer 50 is activated to seal the annulus 15 between the production tubing string 105 (which is inserted into the wellbore 30 instead of the production tubing string 20 shown in FIG. 1) and the wellbore 30. At this point, production fluid P may be forced by the packer 50 and existing pressure within the wellbore 30 into the bore of the production tubing string 105.

Although the production tubing string 105 may be placed within the wellbore 30 with the gas lift valves 135 already installed within the side pockets 120, it is also within the scope of embodiments of the present invention that the production tubing string 105 is inserted into the wellbore 30 without the gas lift valves 135 within the side pockets 120. In this scenario, the gas lift valves 135 are installed with the retrieval tool (not shown), for example the kickover tool, while the production tubing string 105 is located downhole according to the procedure described below. In the event the gas lift valves are installed after the production tubing string is in the wellbore, the slot 125 provides fluid communication between the pocket and the tubing which permits fluid to be displaced as the gas lift valve is inserted into the pocket.

Returning to the embodiments in which the gas lift valves 135 are lowered into the wellbore 30 with the production tubing string 105, once the production tubing string 105 is disposed downhole, any existing production fluid P within the annulus 15 is removed through the gas lift valves 135 by flowing into the production tubing string 105 through the side pockets 120. Next, if additional lift force is desired or needed to convey the production fluid P to the surface of the wellbore 30, the gaseous fluid G is selectively injected into the annulus 15 using the valve system 35 located at the surface of the wellbore 30.

The flow of the gas G is described first with reference to FIG. 3. The gas G travels down the annulus and into the second ends 155, (other not shown) of the first and second one-way valves 150, (other not shown) disposed at each side pocket 120. The gas G is allowed to flow through the bore 158 of the first one-way valve 150, out of the first one-way valve 150, and upward through the first port 122. Likewise, the gas G flows through the bore of the second one-way valve (not shown), out of the second one-way valve, and upward through the second port 123 (shown in FIGS. 2A and 2B).

The gas G continues to flow in two separate flow paths through the first and second ports 122, 123 until the first port 122 intersects with the third port 124 and the second port 123 intersects with the fourth port 126. At these intersections, the gas G flows inward as shown in FIG. 2B towards the side pocket 120 (and towards the gas lift valve 135). The third and fourth ports 124, 126 are substantially aligned with the first and second slots 131A, 131B through the body 305 of the gas lift valve 135.

After flowing through the slots 131A, 131B, the two gas streams previously flowing through the two ports 124, 126 meet to become one gas stream. The gas lift valve 135 allows the gas G to flow downward within the gas lift valve 135 through the central bore 136. The gas G eventually flows out through the lower end 302 of the gas lift valve 135 and into the side pocket 120 between the gas lift valve 135 and the one-way valves 150, (other not shown). As depicted in FIG. 3, from the side pocket 120, the gas G flows out through the slot 125 in the side pocket mandrel 110 and into the bore 127 of the production tubing 105.

Once the gas G is within the bore 127 of the production tubing string 105, the gas G merges with the production fluid P to form a gas/production fluid mixture stream F (see FIG. 3). The gas G aids in lifting the production fluid P to the surface.

During the gas lift operation described above, the gas lift valve 135 prevents fluid from flowing in a second direction from the bore 127 of the production tubing string 105 into the annulus between the production tubing string 105 and the surrounding wellbore in the following manner. Fluid flow from the bore 127 has a potential inlet into the side pocket 120 through the slot 125. The slot 125 leads to the side pocket 120. The only way that fluid may reach the annulus from the side pocket 120 involves the fluid flowing upward through the central bore 136 of the gas lift valve 135, out through the third and fourth ports 124, 126, downward through the walls around the side pocket 120 via the first and second ports 122, 123, and out through the bores 158, (other not shown) of the one-way valves 150, (other not shown). However, the one-way valve portion of the gas lift valve 135 stops flow of fluid from the central bore 136 into the third and fourth ports 124, 126, thereby preventing flow into the annulus.

Additionally, if fluid flow should somehow move past the one-way valve portion of the gas lift valve 135 into the third and/or fourth ports 124, 126, the first and/or second one-way valves 150, (other not shown) act as backup mechanisms for blocking the flow of fluid from the bore 127 into the annulus. Instances in which the flow may somehow move past the one-way valve portion of the gas lift valve 135 include but are not limited to failure of the gas lift valve 135 or removal the gas lift valve 135 from the side pocket 120. The one-way valves 150, (other not shown), specifically the cooperation of their check members 162, (other not shown) with the check seats 163, (other not shown), prevent fluid flow from their respective ports 122, 123 into the annulus.

Therefore, the one-way valves 150, (other not shown) prevent fluid flow in the second direction (from the bore 127 of the production tubing 105 into the annulus) independent of the operation of the gas lift valve 135. At the same time, the one-way valves 150, (other not shown) allow fluid flow in the first direction (from the annulus into the production tubing 105), thereby permitting the gas G to artificially lift the production fluid P. Accordingly, the gas lift valve 135 may be removed while the production tubing string 105 remains downhole, e.g. removed by a retrieval tool, while fluid is still prevented from flowing in the second direction into the annulus. The one-way valves 150, (not shown) further an efficient gas lift operation by eliminating the time required and the resulting cost to unload production fluid P from the annulus prior to resuming a gas lift operation upon failure or removal of the gas lift valve 135 and by eradicating the damage to the surrounding casing caused by production fluid P within the annulus upon failure or removal of the gas lift valve 135.

Preferably, the one-way valves 150, (other not shown) remain permanently with the production tubing 105 while the production tubing 105 is downhole. It is also within the scope of embodiments of the present invention that the one-way valves 150, (other not shown) may be retrievable.

Although the description of embodiments above focuses on including two ports 122, 123 through the wall of the side pocket 120, it is also within the scope of embodiments of the present invention that one port, or more than two ports, may be included through the side pocket 120 wall. Additionally, the gas lift valve 135 is only an example of a gas lift valve usable with embodiments of the present invention, and any other known gas lift valve is capable of use in embodiments of the present invention. Similarly, the one-way valve 150 described above is only one type of one-way valve usable in embodiments of the present invention, and any other one-way valve, including flapper valve, check valve, ball valve, etc., is also usable in embodiments of the present invention in lieu of the one-way valve 150 depicted. Finally, the latching mechanism 145 and the kickover tool described above are only examples of latching mechanisms and retrieval tools for the gas lift valve 135 usable with embodiments of the present invention, but it is understood that embodiments of the present invention also include use of any latching mechanism or retrieval tool for a gas lift valve known to those skilled in the art in lieu of the latching mechanism 145 and kickover tool shown and/or described above.

Any directional terms used in the description above are merely illustrative, for example, the terms "upward", "downward", etc., and not limiting. It is understood that the production tubing string 105 described above is usable within any orientation of wellbore, including but not limited to a vertical, horizontal, directionally-drilled, or lateral wellbore.

While the foregoing is directed to embodiments of the present invention, other and further embodiments of the invention may be devised without departing from the basic scope thereof, and the scope thereof is determined by the claims that follow.

The invention claimed is:

1. A gas lift system for use in a wellbore, comprising:

at least one side pocket mandrel having a side pocket therein;

a first, retrievable one-way valve member within the side pocket for preventing fluid flow from within the mandrel to outside the mandrel; and one or more second one-way valve members attached to the side pocket, the first and second one-way valve members in fluid communication with one another via one or more ports which direct fluid flow along a central axis of the side pocket and extend to a lower end of the side pocket mandrel, wherein the one or more second one-way valve members are removeably attached to the one or more ports, outside the side-pocket mandrel.

2. The gas lift system of claim 1, wherein a fluid communication path exists between the outside of the side pocket mandrel and the inside of the side pocket mandrel through the first and second one way valve members.

3. The gas lift system of claim 1, further comprising a slot through the side pocket mandrel is configured to provide fluid communication between the side pocket and the inside of a bore of a production tubing.

4. The gas lift system of claim 3, wherein the first and second valve members allow fluid communication between the slot and an annulus outside the mandrel.

5. The gas lift system of claim 4, wherein the slot is configured to permit fluid displacement during installation of the first retrievable one-way valve member and introduction of a gaseous fluid into the bore.

6. The gas lift system of claim 1, wherein the first and second valve members allow fluid flow between the outside of the mandrel and the inside of the mandrel in a first direction.

7. The gas lift system of claim 6, wherein the first direction is between the outside of the mandrel and the inside of the mandrel.

8. The gas lift system of claim 1, wherein the one or more second valve member is positive-loaded.

9. The gas lift system of claim 8, wherein the second valve member is injection pressure operated.

10. The gas lift system of claim 1, wherein the one or more second valve members are check valves.

11. The gas lift system of claim 1, further comprising a screen coupled the one or more second one-way valve members, wherein the filter is configured to filter solids from a gas.

12. The gas lift system of claim 1, wherein the one or more ports are substantially parallel to the central axis of the side pocket.

13. A method of preventing fluid flow from a bore of a production tubing to an annulus between an outer diameter of the production tubing and a wellbore, comprising:

providing the production tubing having a side pocket mandrel therein in the wellbore, the side pocket mandrel having a side pocket with at least one first one-way valve member therein and at least one second one-way valve member wherein the at least one second one-way valve is integral with the side pocket and located below the first one-way valve, wherein the at least one second one-way valve is attached to the one or more ports outside the side-pocket mandrel;

introducing a gaseous fluid into the annulus;

flowing the gaseous fluid from the annulus, wherein the fluid flows through the at least one second one-way valve into one or more ports extending from the second one-way valve at the lower end of the side pocket to the first one-way valve then into the bore through the side pocket mandrel; and preventing flow of a second fluid from the bore into the annulus using at least one of the valve members.

14. The method of claim 13, wherein the valve members are one-way valves preventing fluid flow from the bore into the annulus while allowing fluid flow from the annulus into the bore.

15. The method of claim 13, wherein the second fluid is production fluid.

16. The method of claim 13, further comprising lowering a hydrostatic pressure within the bore to lift the second fluid using the gaseous fluid flowing into the bore.

17. The method of claim 13, further comprising removing at least one of the one or more first valve members from the production tubing.

18. The method of claim 17, further comprising preventing flow of the second fluid from the bore into the annulus using at least one of the second valve members disposed in a same side pocket as the removed first valve member.

19. The method of claim 18, further comprising replacing the at least one first valve member in the side pocket while the production tubing is disposed within the wellbore.

20. The method of claim 13, further comprising filtering solids from the gaseous fluid with a screen operatively coupled to the at least one second one-way valve.

21. The method of claim 13, wherein the one or more ports are substantially parallel to the bore.

22. A method of installing a gas lift valve into a tubing string located in a wellbore comprising:

running the string into the wellbore, the string having a pocket formed on a side thereof, the pocket having a housing for the gas lift valve formed therein, the housing in fluid communication with a bore of the tubing, the pocket having a second valve disposed at an end of the pocket, wherein the second valve is a one-way valve located at least partially outside of the pocket; and installing the gas lift valve in the housing while displacing fluid from the pocket to the tubing.

23. The method of claim 22, further comprising filtering solids from a gaseous fluid with a screen operatively coupled to the second valve.

24. The method of claim 22, further comprising flowing a gas through the second valve located at a bottom end of the pocket and into at least one first port, wherein the port runs substantially parallel to the tubing string.

25. The method of claim 24, further comprising introducing the gas into the gas lift valve via at least one second port and mixing the gas with a production fluid located in the tubing string.

26. A gas lift system for use in a wellbore, comprising:

a tubular having a side pocket mandrel with a side pocket therein;

a retrievable gas lift valve configured to be removeably located in the side pocket; and one or more one way valves coupleable to the side pocket, configured to allow fluids to enter the side pocket and prevent fluids from flowing out of the side pocket, wherein the one or more one way valves are located below the gas lift valve.

27. The gas lift system of claim 26, further comprising one or more ports for fluidly connecting the one or more one way valves with the gas lift valve.

28. The gas lift system of claim 27, wherein the one or more ports are substantially parallel with a central axis of the gas lift valve.

29. A gas lift system for use in a wellbore, comprising:

at least one side pocket mandrel having a side pocket therein;

a first, retrievable one-way valve member within the side pocket for preventing fluid flow from within the mandrel to outside the mandrel; and one or more second one-way valve members attached to the side pocket, the first and second one-way valve members in fluid communication with one another via one or more ports which extend to a lower end of the side pocket mandrel, wherein the second one-way valve members is removeably attached to the one or more ports, outside the side-pocket mandrel.

* * * * *